United States Patent [19]

Nagatake et al.

[11] Patent Number: 4,467,484

[45] Date of Patent: Aug. 28, 1984

[54] PNEUMATIC CUSHION AND MANUFACTURING METHOD THEREFOR

[75] Inventors: Hiroshi Nagatake; Keiji Hayashi, both of Ashikaga, Japan

[73] Assignees: Nissan Motor Company, Limited, Kanagawa; Achilles Corporation, Tokyo; Ikeda Bussan Company, Limited, Kanagawa, all of Japan

[21] Appl. No.: 349,788

[22] Filed: Feb. 18, 1982

[30] Foreign Application Priority Data

Feb. 19, 1981 [JP] Japan ..... 56-22560[U]

[51] Int. Cl.[3] ..... A47C 27/08

[52] U.S. Cl. ..... 5/449; 5/441; 156/213; 297/DIG. 3

[58] Field of Search ..... 5/449, 450, 441, 453-456; 297/DIG. 3; 156/213, 216

[56] References Cited

U.S. PATENT DOCUMENTS

| | | | |
|---|---|---|---|
| 2,415,150 | 2/1947 | Stein | 5/455 |
| 2,488,993 | 4/1949 | Teague | 5/449 |
| 3,421,163 | 1/1969 | Stoughton | 5/449 |
| 3,568,227 | 3/1971 | Dunham . | |

FOREIGN PATENT DOCUMENTS

| | | |
|---|---|---|
| 136871 | 12/1929 | Switzerland . |
| 539829 | 9/1941 | United Kingdom . |

*Primary Examiner*—Alexander Grosz

*Attorney, Agent, or Firm*—Lowe King Price & Becker

[57] ABSTRACT

A pneumatic cushion fabricated from two sheets of expandable thin material are welded together at a circumferential portion thereof to define therebetween a expandable pneumatic chamber. The welded portion is separated from the pneumatic chamber by a substantially rigid board. The board-like member cooperates with a portion of the sheets mating therewith to isolate the welded portion from tension forces applied to the sheets as the chamber air pressure increases.

29 Claims, 10 Drawing Figures

PNEUMATIC CUSHION AND MANUFACTURING METHOD THEREFOR

BACKGROUND OF THE INVENTION

The present invention relates generally to a pneumatic cushion and manufacturing method therefor. More particularly, the invention relates to a pneumatic cushion made from a thin elastic sheet which can be repeatedly inflated, and a method for manufacturing the pneumatic cushion.

FIG. 1 shows a typical construction of a conventional pneumatic cushion used, for example, for adjusting the firmness of that part of a vehicle seat supporting the lumbar-vertebra area of a passenger's back. As shown in FIG. 1, the pneumatic cushion 10 comprises two pieces of thin elastic sheets 12 and 14 such as a thermoplastic synthetic resin and the like. The sheets 12 and 14 are bonded or welded at a circumferential portion 16 in an air-tight fashion so that a pneumatic chamber 18 is defined therebetween. In the example shown, sheet 14 is provided with an inlet/outlet port 20 for inflating and deflating the cushion.

In such conventional construction, a tension force, as represented by arrows in FIG. 1, is applied to circumferentially extending welded portion 16. If the cushion is subjected to repeated inflation, the internal pressure in pneumatic chamber 18 is repeatedly varied and welded portion 16 is apt to weaken and cause leakage of the air seal. This leakage degrades the usefulness of the pneumatic cushion. Generally, the durability of the welded portion of the cushion is less than the strength of the resin sheet itself. When the pneumatic cushion is used for lumbar support in the vehicle seat, the internal pressure in the pneumatic chamber is frequently varied in response to passenger movement and individual adjustment to achieve the desired firmness. This may possibly cause "weakening or rupturing of the welded portion, resulting in"; leakage of air from the pneumatic chamber.

SUMMARY OF THE INVENTION

Therefore, it is a primary object of the present invention to provide a pneumatic cushion which will not peel off or develop a leak in the welded portion even under repetitive changes in internal pressure in the pneumatic chamber.

Another and more specific object of the invention is to provide a pneumatic cushion having a means for insulating or isolating the welded portion from tension forces created by increasing the internal pressure in the pneumatic chamber.

To accomplish the above-mentioned and other objects, there is provided a pneumatic cushion, according to the present invention, which has a substantially rigid member interpositioned between the pneumatic chamber and the welded portion to insulate same from tension forces applied to the pneumatic chamber as a result of increasing air pressure therein and expanding the volume of the pneumatic chamber.

In the preferred embodiment, the rigid member is a board positioned on one side of pneumatic chamber. The welded portion is located behind the board so that the circumferential edge thereof and the portion chamber wall sheet mating to the circumferential edge of the board serve as insulating means for insulating the welded portion from tension forces.

A further object of the invention is to provide a method for manufacturing the pneumatic cushion of the present invention.

According to the invention, the manufacturing method of the pneumatic cushion includes the steps of first welding together the circumferential portions of sheets forming the pneumatic chamber and then locating the welded circumferential portions behind a rigid member forming one side of an expandable pneumatic chamber. The rigid member is then fitted to one of the sheets and movement of the welded portion is restricted so that it may not move to the side facing the pneumatic chamber.

BRIEF DESCRIPTION OF THE DRAWINGS

The present invention will be understood more fully from the detailed description below and from the accompanying drawings of the preferred embodiment of the present invention, which, however, should not be taken as limitative of the invention but for elucidation and explanation only.

In the drawings.

DESCRIPTION OF THE PREFERRED EMBODIMENT

Figure 1:
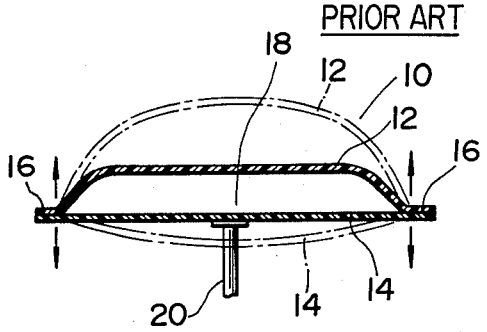
FIG.1 PRIOR ART
FIG. 1 is a cross-sectional view conventional pneumatic cushion.

Referring now to the preferred embodiment of a pneumatic cushion according to the present invention, the structure and method for manufacturing is illustrated herebelow with reference to FIGS. 2 to 6. The pneumatic cushion 30 generally comprises a substantially rectangular thin first sheet 32 and a substantially rectangular thin second sheet 34. The first and second sheets 32 and 34 are made of elastically expandable thermoplastic material, such as a thermoplastic synthetic resin. Although first and second sheets 32, 34 are vinyl chloride resin, it is possible to choose polyethylene, nylon, polyester or the like. Both first and second sheets 32, 34 are welded at circumferential portion 36 utilizing well known welding techniques, such as heat welding, high-frequency welding, ultra-sonic welding or the like to form an air-tight seal. First and second sheets 32, 34 define a pneumatic chamber 38 in which air may be introduced.

Second sheet 34 is formed with openings to define an air inlet/outlet port 40 and a relief port 42 together with connector tubes 44 and 46. Air inlet/outlet port 40 communicates with an air source (not shown) for supplying air thereto and receiving air therefrom. Relief port 42 is connected to a relief valve (not shown) for relieving air pressure in the pneumatic chamber exceeding a predetermined value.

It should be noted that, although the embodiment herein illustrated is provided with an inlet/outlet port and relief port to adjust air pressure in the pneumatic chamber, these ports are not always necessary and can be omitted depending on the manner of use.

A substantially rectangular rigid board 48 such as a synthetic resin plate, wooden plate or metal plate, is provided on the second sheet 34. Rigid board 48 is formed with openings 47 and 49 to receive connector tubes 44, 46 passing therethrough. Board 48 is placed on second sheet 34 by passing connector tubes 44, 46 through openings 47, 49. First and second sheets 32, 34 are turned back so that welded portion 36 is placed behind the rigid board with respect to pneumatic chamber 38. For this purpose, board 48 is smaller than the rectangular area defined by weld portion 36 as indicated by dotted line W in FIG. 3.

A pair of extensions 50 and 52 of first sheet 32 extend along opposite longitudinal edges thereof. Extensions 50 and 52 respectively have a width wider than half of the rigid board width. Extensions 50 is formed with openings 51 and 53 to permit connector tubes 44, 46 pass therethrough. Extensions 50, 53 are turned back together with the welded portion to mate both end portions thereof behind the rigid board. The mated end portions of the extensions 50 and 52 are welded together at portion 54. A pair of extensions 56 and 58 of second sheet 34 extend along opposite lateral edges thereof. Extension 56 is approximately equal to the length of the rigid board and is formed with openings 55 and 57 to receive connector tubes 44, 46 passing therethrough. On the other hand, extension 58 is of substantially short length to mate with the end of extension 56 adjacent the edge on which it is provided. The extension 56 is placed over the welded portions 36, 54 and is welded to a extension 58 at a portion 60 (see FIG. 2).

Figure 3:
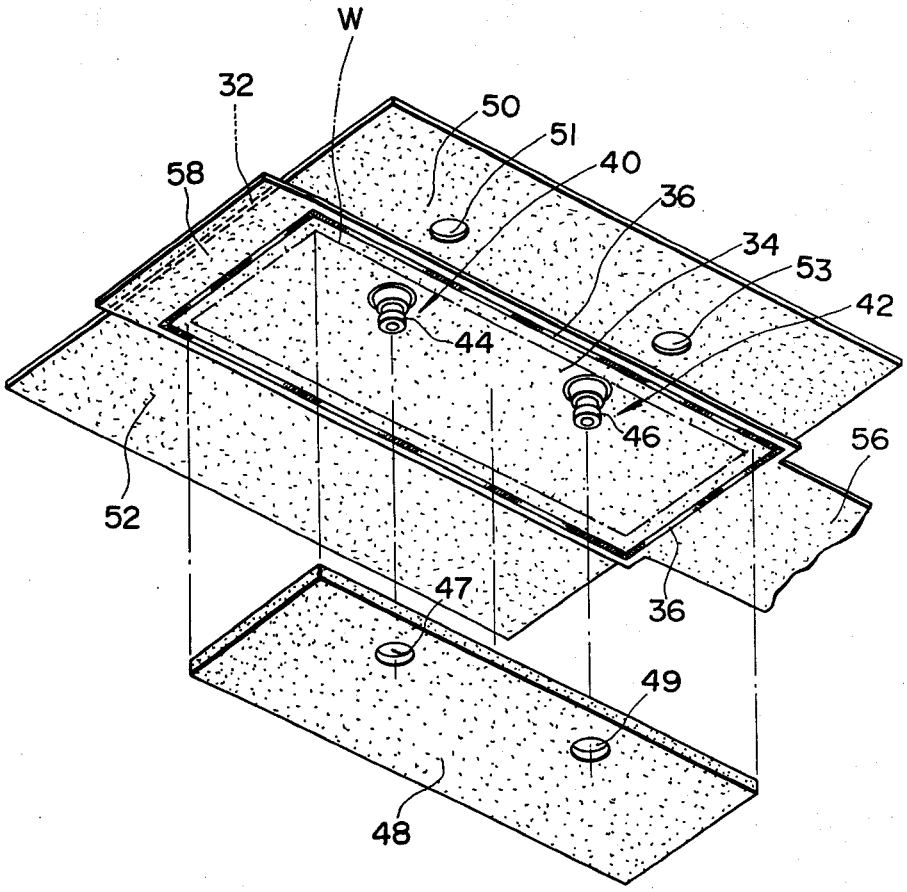
FIG. 3 is an exploded perspective view of the pneumatic cushion of FIG. 2, showing each member of the pneumatic cushion.
Figure 4:
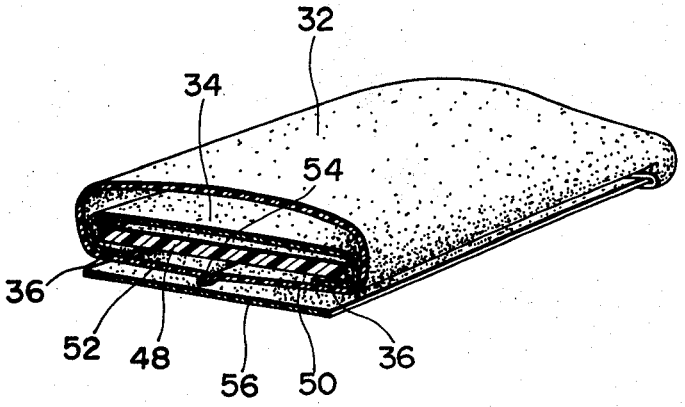
FIG. 4 is a cross-sectional of the pneumatic cushion of FIG. 2.
Figure 6:
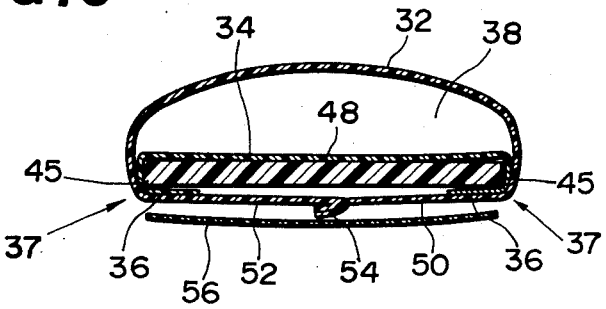
FIG. 6 is an enlarged cross-section of the pneumatic cushion in a position expanding by increasing of the internal pressure in the pneumatic chamber.

Extensions 50, 52 and 56, 58 prevent movement of welded portion 36 the the side of board 48 facing pneumatic chamber 38. If this movement were to occur, weld portion 36 would be subject to tension forces as air pressure in pneumatic chamber 38 increases, as shown in FIG. 6. However, because of the construction of the cushion in accordance with the invention the tension forces applied to sheets 32, 34 are received by the edges of rigid board 48 so that they are not applied to the welded portion which remains isolated therefrom by being positioned away from the edge of the board as shown in FIGS. 2–4.

Figure 2:
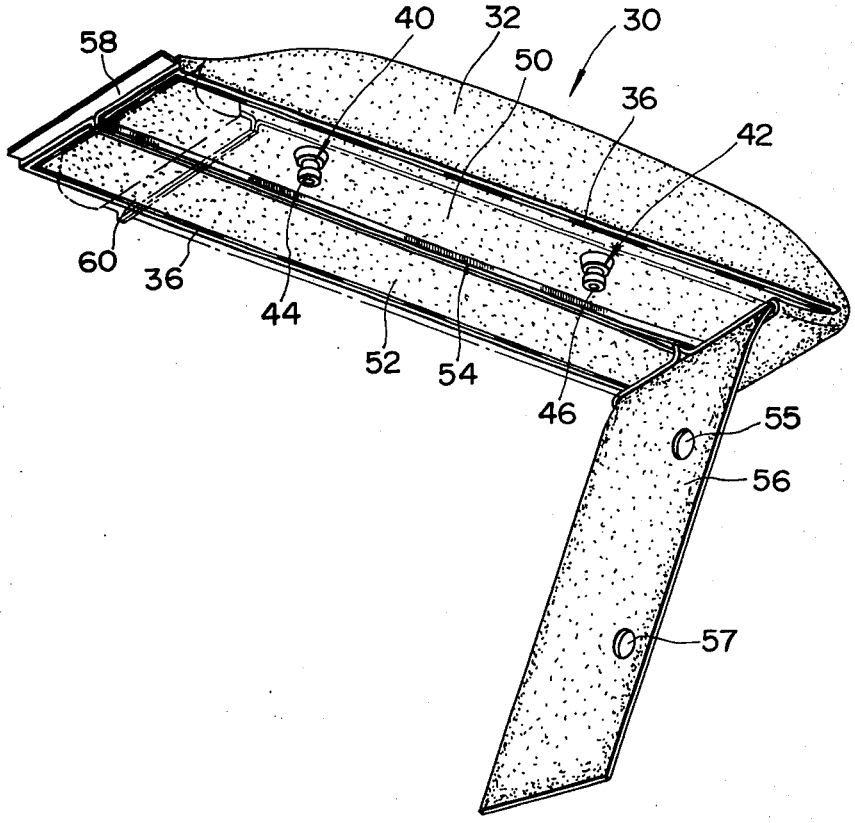
FIG. 2 is a perspective view of the preferred embodiment of a pneumatic cushion according to the present invention.

During manufacture, first and second sheets 32 and 34 are piled together and welded along the circumferential edges at welded portion 36, as shown in FIG. 2. Pneumatic chamber 38 is thusly formed between first and second sheets 32, 34 at the area defined by the welded portions. Rigid board 48 is then placed on the surface of second sheet 34 with connector tubes 44 and 46 extending from the second sheet through openings 47, 49.

In this position, extensions 50, 52 are turned back so that welded portion 36 is positioned on the opposite side of rigid board 48 in relation to the pneumatic chamber. Openings 51 and 53 of extension 50 engage with connector tubes 44 and 46 in this position. Then, the mating edge of extensions 50 and 52 are welded together at portion 54 extending along the longitudinal center line of the rigid board, as clearly shown in FIG. 2. Thereafter, extension 56 of second sheet 34 is placed over welded portions 36 and 54 with openings 55, 57 receiving connector tubes 44, 46. The edge of extension 56 mates with the edge of extension 58 to be welded at portion 60. Thereby, pneumatic cushion 30 of the preferred embodiment is assembled.

Figure 5:
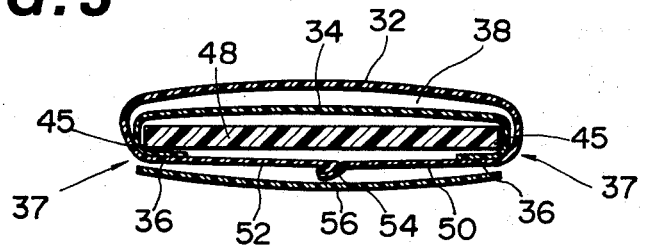
FIG. 5 is an enlarged cross-sectional of the pneumatic cushion of FIG. 2 in a deflated condition.

When air pressure in pneumatic chamber 38 is maintained at atmospheric pressure, pneumatic cushion 30 is in the condition illustrated in FIG. 5. If air is introduced through inlet/outlet port 40 to inflate the air cushion, the air pressure in pneumatic chamber 38 increases to expand the internal volume of the pneumatic chamber. This causes second sheet 34 defining part of pneumatic chamber 38 to be pressed onto the rigid board. Simultaneously, a tension force expanding the chamber is applied to first sheet 32 to urge together a portion 37 of first and second sheet 32 34 with an edge 45 of the rigid board (FIG. 6). Thus, tension force applied to first sheet 32 is received at the portion 37 and the welded portion 36 is insulated from the tension force.

Figure 7:
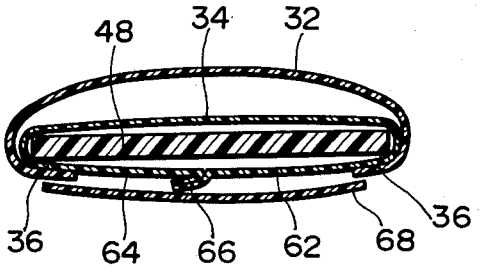
FIG. 7 is a cross-sectional similar to FIG. 5 but showing a modification of the preferred embodiment of the pneumatic cushion.
Figure 8:
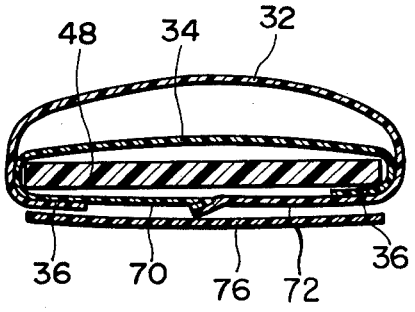
FIG. 8 is a cross-section similar to FIG. 5 but showing another modification of the preferred embodiment of the pneumatic cushion.

In the FIG. 7 embodiment of the invention extensions 62 and 64 are provided along the longitudinal edges of second sheet 34. Extensions 62, 64 are welded at a portion 66 substantially along the longitudinal center line of the rigid board. An extension 68 is further provided on first sheet 32 to be placed over welded portions 36, 66. Extension 68 is welded to the opposing edge of first sheet 32. In FIG. 8, an extension 70 projects from second sheet 34 along the longitudinal edge thereof. Extension 70 mates at one end thereof with an extension 72 which extends from first sheet 32 along the opposite longitudinal edge. The mated ends of extensions 70 and 72 are welded together. This welded portion is covered with another extension 76 extending longitudinally from first or second sheet 32 or 34.

It should be noted that the means for restricting movement of the welded portion does not necessarily have to be extensions formed in the first and second sheet 32 and 34 but separate sheets can be used for this purpose. Also, the manner of welding the extensions is not limited to the specific form illustrated and modifications may readily be made within the scope of the invention.

Figure 9:
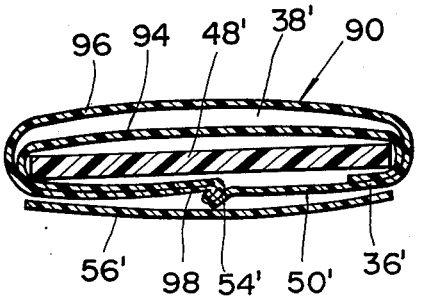
FIG. 9 is a cross-section showing another embodiment of a pneumatic cushion according to the present invention.

FIG. 9 shows another embodiment of the invention wherein a single expandable sheet 90 is utilized in combination with a rigid board 48'. The sheet 90 is folded at a portion 98 thereby forming two sections 94 and 96. Pneumatic chamber 38' is established between sections 94, 96. This embodiment may also be understood in relation to FIG. 3 is the sheets 34 and 32 are considered one sheet folded at edge 98. For this purpose sheet 34 is imagined as extended to edge 98 where the fold occurs such that sheet 32 (and extensions 52 and 50) correspond to section 96 of FIG. 9 and sheet 34 (and extensions 58 and 56) which is imagined as further extending to fold 98 corresponds to section 94 of FIG. 9. In all other aspects, (including the position of the weld portion) FIG. 3 can correspond to FIG. 9, as may be seen by comparing the cross section view of FIG. 5 with that of FIG. 9. Prime numbers indicate corresponding portions of the embodiments of FIGS. 9 and FIGS. 3–5.

Figure 10:
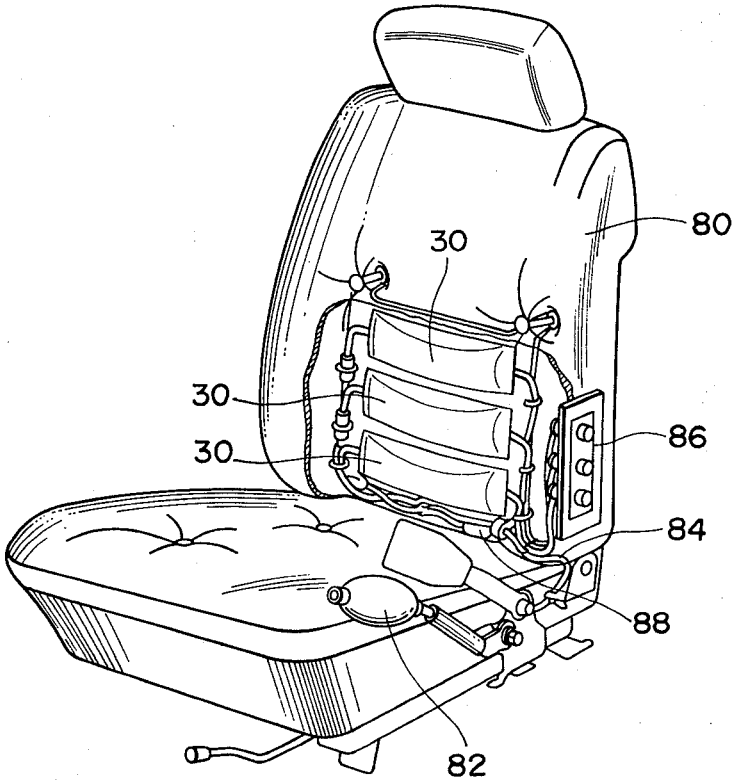
FIG. 10 is a perspective view of a vehicle seat having an air lumbar support.

FIG. 10 shows an example of application of the pneumatic cushion of the present invention for an air lumbar support of a vehicle seat. As shown herein, a plurality of pneumatic cushions 30 are placed within a seat back 80 of the vehicle seat in a manner such that pneumatic chamber 38 of each pneumatic cushion is adjacent the back of the passenger. Inlet/outlet port 40 is connected to an air pump 82 which is manually operable, via a tube 84. Inlet/outlet port 40 is also connected to a manually operable pressure control valve 86. Therefore, the passenger may adjust the lumbar support position as desired by operating the air pump 82 and control valve 86.

In FIG. 10, reference numeral 88 denotes a relief valve connected to relief port 42 for preventing air pressure in the pneumatic chambers from exceeding a predetermined pressure.

The pneumatic cushion forming to the air lumbar support of the vehicle seat, is subject to repeated variation in; internal air pressure in the pneumatic chamber. Since the pneumatic cushion of the invention isolates the welded portion from tension forces created by the air pressure in the pneumatic chamber, the welded portion is not peel off or damaged and thus does not leak. Thus, according to the invention, durability of the pneumatic cushion is remarkably improved.

What is claimed is:

1. A pneumatic cushion comprising:

an expandable air-tight bag like member having side walls defining a pneumatic chamber, said side walls including an air tight welded portion extending along the circumference of said chamber; and means for isolating said welded portion from tension forces acting on the chamber side walls resulting from pneumatic pressure in said pneumatic chamber.

2. A pneumatic cushion as set forth in claim 1, wherein said bag like member includes a first expandable sheet and a second expandable sheet forming said side walls, said sheets secured to each other along said air tight welded portion.

3. A pneumatic cushion as set forth in claim 1, wherein said bag like member includes a single expandable sheet folded to form first and second sections at least partially overlying one another.

4. A pneumatic cushion as set forth in claim 1, 2 or 3, wherein said isolating means includes a substantially rigid board and means for retaining said welded portion behind the rigid board on one side thereof, the other side of said rigid board positioned adjacent said pneumatic chamber.

5. A pneumatic cushion as set forth in claim 4, wherein said retaining means includes a strip attached to said bag like member and overlapping at least part of said welded portion, said strip secured at an end thereof to a portion of said bag like member remote from said overlapped welded portion.

6. A pneumatic cushion as set forth in claim 5, wherein said retaining means includes a first strip and a second strip respectively extending from parallel edges of said bag like member and welded at mating end portions thereof on said one side of said board, and a third strip extending from a lateral edge with respect to said parallel edges, said first, second and third strips overlapping at least part of said welded portion.

7. A pneumatic cushion comprising a first expandable sheet;

a second expandable sheet positioned adjacent said first sheet and secured thereto along an air tight welded portion, said first and second sheets defining a pneumatic chamber therebetween in a area surrounded by the welded portion and means for isolating the welded portion from tension forces applied to said first and second sheets resulting from pneumatic pressure in said pneumtic chamber.

8. A pneumatic cushion as set forth in claim 7, wherein said isolating means includes a substantially rigid board and a means for holding said welded portion behind the rigid board on one side thereof, the other side of said board positioned adjacent said pneumatic chamber.

9. A pneumatic cushion as set forth in claim 8, wherein said holding means includes an extension of at least one of said first and second sheets, said extension overlapping at least part of said welded portion and secured at an end thereof to one of said first and second sheets.

10. A pneumatic cushion as set forth in claim 8, wherein said holding means includes a first section and a second section respectively extending from parallel edges of one of said first and second sheets and welded at mating end portions thereof on said one side of said board, and a third section extending from a lateral edge with respect to said parallel edge of the other of said first and second sheets, said first, second and third sections overlapping at least part of said weld portion.

11. A pneumatic cushion as set forth in claim 7, wherein said holding means includes a first section extending from one of said first and second sheets along one edge thereof and a second section extending from the other of said first and second sheets along an opposite side edge with respect to said one edge, and a third section placed over said first and second sections, said third section extending from one of said first and second sheets along the edge extending lateral to said one edge, said first, second and third sections overlapping at least parts of said welded portion and secured to one of said first and second sheets.

12. A pneumatic cushion as set forth any one of claims 7 to 11, wherein one of said first and second sheets is provided with a port for communicating with a pneumatic pressure source for adjustment of pneumatic pressure in the pneumatic chamber.

13. A method for manufacturing a pneumatic cushion comprising the steps of:

cutting a first sheet and a second sheet from a thermoplastic expandable thin sheet blank;

forming a gas tight expandable pneumatic chamber by welding said first and second sheets to form a welded seam;

placing one side of a substantially rigid board adjacent a surface of said second sheet at a location opposite said pneumatic chamber;

turning the welded seam so that the welded seam is located on the other side of said rigid board opposite said pneumatic chamber; and securing said turned weld seam behind the rigid board.

14. A method as set forth in claim 13, wherein said thermoplastic sheet blank is made of a thermoplastic synthetic resin.

15. A method as set forth in claim 14, wherein said thermoplastic synthetic resin is vinyl chloride resin.

16. A method as set forth in claim 14, wherein said thermoplastic synthetic resin is polyethylene.

17. A method as set forth in claim 14, wherein said thermoplastic synthetic resin is nylon.

18. A method as set forth in claim 14, wherein said thermoplastic synthetic resin is polyester.

19. A method as set forth in claim 13, comprising the further step of providing an air inlet and outlet port in one of said first and second sheets.

20. A method as set forth in any one of claims 13 to 19, wherein said securing step includes overlapping a holding member formed integrally with at least one of said first and second sheets around said rigid board and over at least a part of said welded seam.

21. A pneumatic cushion comprising:

an expandable air-tight bag like member defining a pneumatic chamber, said member including an air tight welded portion; and means for reducing tension forces applied to said welded portion of said bag like member resulting from pneumatic pressure in said pneumatic chamber, said reducing means causing a clamping effect to occur adjacent said welded portion to reduce said tension forces transmitted to said welded portion.

22. The cushion of claim 21, wherein said reducing means is an isolating means.

23. A pneumatic cushion comprising:

an expandable air-tight bag like member defining a pneumatic chamber, said member including an air tight welded portion extending along an edge thereof; and means for reducing tension forces applied to said welded portion of said bag like member resulting from pneumatic pressure in said pneumatic chamber, said reducing means clamping a portion of said bag like member adjacent said welded portion in response to tension forces acting on said bag like member to reduce said tension forces tending to act upon the welded portion.

24. The cushion of claim 23, wherein said reducing means is an isolating means.

25. A pneumatic cushion comprising:

an expandable air-tight bag like member defining a pneumatic chamber, said member including an air tight welded portion extending along an edge thereof; and means for reducing tension forces applied to said welded portion of said bag like member resulting from pneumatic pressure in said pneumatic chamber, said reducing means comprising a substantially rigid board and means for holding said welded portion behind the rigid board on one side thereof, the other side of said rigid board positioned adjacent said pneumatic chamber.

26. A pneumatic cushion as set forth in claim 25, wherein said holding means comprises a strip attached to said bag like member and overlapping at least part of said welded portion, said strip secured at an end thereof to a portion of said bag like member remote from said overlapped welded portion.

27. A pneumatic cushion as set forth in claim 26, wherein said holding means comprises a first and second strip extending from parallel edges of said bag like member and welded at mating end portions thereof on said one side of said board, and a third strip extending from a lateral edge with respect to said parallel edges, said first, second and third strips overlapping at least part of said welded portion.

28. A pneumatic cushion comprising:

an expandable air-tight bag like member defining a pneumatic chamber said member including an air tight welded portion extending along the edge thereof; and means for reducing tension forces applied to said welded portion of said bag like member resulting from pneumatic pressure in said pneumtic chamber and for clamping a portion of said bag like member adjacent said welded portion so that said tension forces are not applied to said welded portion said reducing means including a substantially rigid board and means for holding said welded portion behind the rigid board on one side thereof, the other side of said rigid board positioned adjacent said pneumatic chamber.

29. A pneumatic cushion comprising:

a first expandable sheet;

a second expandable sheet positioned adjacent said first sheet and secured thereto along an air tight welded portion, said first and second sheets defining a pneumatic chamber therebetween in an area surrounded by the welded portion; and means for isolating the welded portion from tension forces applied to said first and second sheets and resulting from pneumatic pressure in said pneumatic chamber, said isolating means clamping said first and second sheets at a portion adjacent said welded portion to block transmission of said tension forces to said welded portion.

* * * * *